United States Patent [19]

Uggerud

[11] Patent Number: 4,627,123

[45] Date of Patent: Dec. 9, 1986

[54] BED TICK WITH POCKET FOR USER'S FEET

[76] Inventor: Kristian Uggerud, Peder Holters vei 1, 1168 Oslo 11, Norway

[21] Appl. No.: 740,268

[22] PCT Filed: Sep. 19, 1984

[86] PCT No.: PCT/NO84/00036

§ 371 Date: May 20, 1985

§ 102(e) Date: May 20, 1985

[87] PCT Pub. No.: WO85/01200

PCT Pub. Date: Mar. 28, 1985

[30] Foreign Application Priority Data

Sep. 20, 1983 [NO] Norway ..... 833382

[51] Int. Cl.[4] ..... A47G 9/02

[52] U.S. Cl. ..... 5/485; 5/501

[58] Field of Search ..... 5/485, 482, 494, 501, 5/500, 502

[56] References Cited

U.S. PATENT DOCUMENTS

| | | | |
|---|---|---|---|
| 3,241,161 | 3/1966 | Dashosh | 5/501 |
| 3,521,309 | 7/1970 | Evans | 5/494 |
| 3,824,640 | 7/1974 | Golden | 5/485 |
| 4,045,831 | 9/1977 | Clark | 5/485 |

*Primary Examiner*—Alexander Grosz

*Attorney, Agent, or Firm*—Wenderoth, Lind & Ponack

[57] ABSTRACT

An ordinary bed tick or case for a bed cover, such as a quilt or eiderdown, is provided with a pocket, for example in the form of a piece of fabric secured along parts of its marginal edges to the bed tick. The pocket is adapted to receive the feet of a user sleeping or resting in a bed, to protect the feet against cold and draft.

4 Claims, 2 Drawing Figures

BED TICK WITH POCKET FOR USER'S FEET

BACKGROUND OF THE INVENTION

This invention relates to a bed tick or case for a bed cover such as a eiderdown, quilt or the like intended to cover the body of a person sleeping or resting in a bed.

A problem with such a bed cover, especially during the winter, is that cold air tends to creep in between the bed cover and the support (mattress) at the foot end of the bed where the user may find it difficult to keep the bed cover sealingly and warmly in place. Such air leaks may cause a discomforting and disturbing cooling of the user's feet.

The present invention solves this problem in a very simple and economical manner by providing the bed tick or case with a pocket adapted to receive the user's feet.

Through this simple measure, the bare feet of the user are protected against cold air streams while the weight of the feet in the pocket anchors the bed tick to the support in a manner which minimizes any air leaks between the cover and the support and retains the bed cover fixedly in position without any tendency of sliding laterally, as otherwise would often be the case.

BRIEF DESCRIPTION OF THE DRAWINGS

The invention will now be described in further detail with reference to the drawings in which:

FIG. 1 is a perspective view of a bed cover with a bed tick or case according to the invention; while.

DESCRIPTION OF THE PREFERRED EMBODIMENTS

Figure 1:
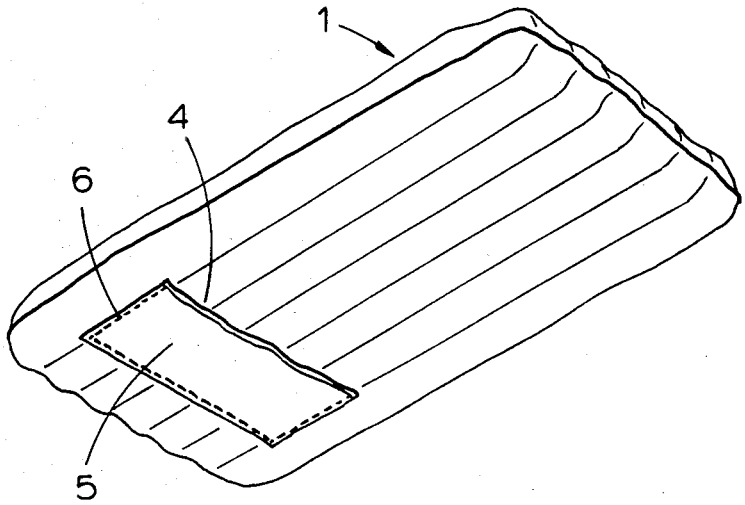
Figure 2:
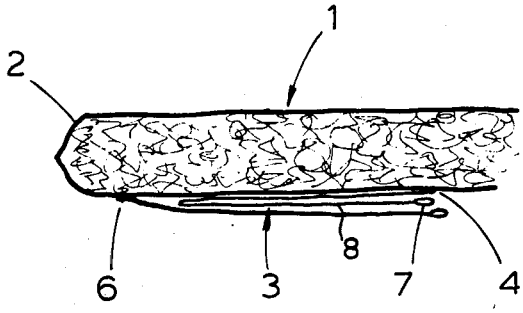
FIG. 2 is an enlarged longitudinal cross-sectional view of an end portion of the bed tick of FIG. 1.

In the drawings the numeral 1 generally denotes a bed cover, such as a quilt or eiderdown provided with a bed tick or case 2. On the external surface of the bed tick 2, near one end thereof, the tick is provided with a pocket 3 which has an opening 4 extending transversely across the bed tick and facing inwardly longitudinally of the bed tick. The pocket 3 may, for example, be formed from a substantially rectangular piece of fabric 5, such as the same material. As that of the bed tick 2. The pocket 3 has a seam 6 along three of its marginal edges, which is secured, by sewing or other means, to the bed tick 2. The seam 6 together with the portion of the bed tick covered by the piece 5, defines the pocket 3.

Preferably the length of the rectangular piece of fabric is somewhat less than the width of the bed tick, and as shown in FIG. 1, the piece 5 is located with its longer dimension transverse to the longitudinal axis of the bed tick, substantially symmetrical thereto, and spaced from the side and end marginal edges of the bed tick.

In use, the bed cover 1 provided with bed tick 2 is placed on the bed (not shown) with the pocket 3 facing the bed sheet at the foot end of the bed, and the user puts his/her feet into the pocket 3 through the opening 4. An easily stretched, elastic strip or band may be disposed along the free marginal edge of the fabric piece 5 at the opening 4, acting to keep said marginal edge close to the tick fabric when the pocket 3 is not in use, and when used, to close the marginal edge of the opening 4 against the ankles or calves of the user.

The width of the fabric piece 5, i.e. the depth of the pocket 3, should be such that the marginal edge of the opening reaches well above the ankles when the feet are fully received in the pocket. A suitable pocket depth would be 20–30 cm for example. Furthermore, the piece of fabric 5 may be so dimensioned and secured to the bed tick 2 such that when it is not in use it is lying substantially flat against the bed tick 2. Thus, there is no substantial bulging or bagginess, since the required space for receiving the feet is provided by the portion of the soft bed cover 1 behind the fabric piece 5, which yieldingly conforms to the feet, surrounding the latter in an insulating and warming manner.

With the feet inserted in the pocket 3, the latter acts as an anchor in retaining the bed cover foot portion in proper position one the bed, such that the marginal edges of the bed cover adjacent to the pocket 3 are retained substantially air tight against the bed sheet or support. The feet of the: user will thus be much more effectively protected and insulated against cold air or draft than is the case when using a conventional bed tick without any pocket.

For an increased thermal insulating effect, the pocket 3 may be internally or externally lined with a suitable thermal insulating material 8 such as wadding, artificial fur and the like and/or provided with electrical heating wires. However, this will normally be unnecessary since the pocket, practically regardless of the nature of the pocket material, will keep the feet of the user sufficiently warm even in a very cold sleeping room, owing to the above described anchoring and sealing effect.

Of course, the invention is not limited to the disclosed rectangular shape of the pocket 3. For example it could be more or less semicircular or semielliptical with the diameter or ellipse axis respectively along the marginal edge of the opening 4, or any other desireable shape.

In order to avoid "cold bridges" it is preferable to have the side and bottom edges of the pocket 3 spaced at some distance, for example 10–15 cm, within the marginal edges of the bed tick 2, but the pocket 3 may of course extend right out to the bed tick marginal edges if desired.

Although, in the disclosed example, the bed tick 2 is provided with pocket 3 in one end only and on one side, it lies within the scope of the invention to attach such pockets also in the opposite end and/or the opposite side of the bed tick, such that there may be as many as four pockets 3, on a bed tick 2. In such an arrangement there will always be a pocket available at the user's feet regardless of the orientation of the bed cover on the bed.

Although the invention has been described and illustrated in connection with a bed cover 1 having a separate or removable bed tick 2, and normally will be used in such a connection, it may also be applied to bed covers intended to be used without any separate bed tick, the pocket 3 then being attached directly to the external surface of such a bed cover.

I claim:

1. A bed tick for a quilt having an external pocket near an end thereof dimensioned to receive solely the feet of an adult user, comprising:

a bed tick extending in a longitudinal direction from one end to another end thereof, said bed tick having a predetermined width; and at least one pocket comprising a piece of fabric having a marginal edge along the periphery thereof extending transversely to said longitudinal direction and facing away from said one end of said bed tick, said marginal edge defining an opening into said pocket, said piece of fabric having the remaining portion of the periphery thereof fixedly secured by a seam to said bed tick, said pocket extending in said longitudinal direction for a distance less than said predetermined width of said bed tick.

2. The bed tick of claim 1, wherein an easily stretchable elastic band is disposed along said marginal edge of said pocket.

3. The bed tick of claim 2, wherein said pocket is lined with a thermal insulation material.

4. The bed tick of claim 1, wherein said pocket is lined with a thermal insulation material.

* * * * *